US006524125B2

(12) United States Patent
Nakamura

(10) Patent No.: US 6,524,125 B2
(45) Date of Patent: Feb. 25, 2003

(54) LOW PROFILE FITTING DETECTING CONNECTOR

(75) Inventor: Hideto Nakamura, Yokkaichi (JP)

(73) Assignee: Sumitomo Wiring Systems Ltd., Yokkaichi (JP)

( * ) Notice: Subject to any disclaimer, the term of this patent is extended or adjusted under 35 U.S.C. 154(b) by 0 days.

(21) Appl. No.: 09/901,101

(22) Filed: Jul. 10, 2001

(65) Prior Publication Data

US 2002/0006745 A1 Jan. 17, 2002

(30) Foreign Application Priority Data

Jul. 12, 2000 (JP) ..... 2000-211736

(51) Int. Cl.[7] ..... H01R 13/627

(52) U.S. Cl. ..... 439/352; 439/159; 439/138; 439/489

(58) Field of Search ..... 439/159, 352, 439/138, 353, 354, 355, 488, 489

(56) References Cited

U.S. PATENT DOCUMENTS 5,876,230 A * 3/1999 Nishide et al. ..... 439/352
5,919,056 A * 7/1999 Suzuki et al. ..... 439/352
6,095,843 A * 8/2000 Kaneko et al. ..... 439/352
6,102,726 A 8/2000 Tsuji et al.
6,135,802 A 10/2000 Nakamura
6,196,867 B1 * 3/2001 Kawase et al. ..... 439/489

OTHER PUBLICATIONS

Communication and European Search Report dated Apr. 19, 2002.

* cited by examiner

*Primary Examiner*—P. Austin Bradley
*Assistant Examiner*—Truc Nguyen
(74) *Attorney, Agent, or Firm*—Banner & Witcoff Ltd.

(57) ABSTRACT

The invention provides a latching connector having a reduced height. Receiving plates 26 are pushed by pushing members 44 as the fitting of two housings 10 and 40 progresses. If the fitting of two housings 10 and 40 is halted while they are in a half-fitted state, compressible coiled springs 25 push the pushing members 44 back, this allowing the half-fitted state of the two housings 10 and 40 to be detected. Position moving means 20 (which consists of the compressible coiled springs 25 and a slider 21) and a locking arm 12 are aligned along an upper face 10S of the first housing 10. Consequently, the height of this first housing 10 is reduced, and as a result the height of the connector overall can be reduced.

18 Claims, 8 Drawing Sheets

PRIOR ART

LOW PROFILE FITTING DETECTING CONNECTOR

TECHNICAL FIELD

The present invention relates to a connector provided with a function for detecting a half-fitted state.

BACKGROUND TO THE INVENTION

One example of a connector provided with a function for detecting a half-fitted state is described in JP 11-185880. In this example, as shown in FIG. 12 of this specification, a locking arm 3 provided on an upper face of a first housing 1 bends resiliently upwards while two housings 1 and 2 are being fitted together, this bent locking arm 3 pressing against a slider 4 provided on an upper face of the second housing 2 and causing a spring 5 to compress. When the two housings 1 and 2 reach a correctly fitted state, the locking arm 3 returns resiliently to a locking state and is released from the slider, and the slider 4 is pushed back to its original position.

In the case where the fitting operation is halted while two housings 1 and 2 are in a half-fitted state, the spring 5 causes the slider 4 to push the locking arm 3 back, this separating the two housings 1 and 2. That is, the separation of the two housings 1 and 2 allows the half-fitted state to be detected.

In the conventional connector, the locking arm 3 and the slider 4 are provided on the separate housings 1 and 2, this locking arm 3 making contact with the slider 4 when the locking arm 3 has been bent in a direction of separation relative to the housing 1. Consequently, space is required above the housing 2 both for providing the slider 4, and for housing the locking arm 3 between the housing 2 and the slider 4. As a result, the size of the connector increases.

The present invention has taken the above problem into consideration, and aims to reduce the height of the connector.

SUMMARY OF THE INVENTION

According to the invention there is provided an electrical connector comprising first and second housings engageable on a fitting axis, said first housing having a pivotable locking arm at the exterior thereof and aligned with said fitting axis, said locking arm being engageable with a locking tooth of said second housing by resilient pivoting from a rest position to an active position and back to the rest position, and said connector further including a biasing member at the exterior of said first housing and adapted for movement along said axis, said second housing having an abutment adapted to push said biasing member along said axis as said first and second housings are engaged, and wherein said biasing member and locking arm are disposed laterally side by side on the outer surface of said first housing.

In this specification the term fitting axis refers generally to the direction of movement of said connectors during fitting and separation.

Preferably the locking arm and biasing member are flush at the outer surface, and in the preferred embodiment are also flush with the outer surface of the first housing.

Preferably the positioning means comprises a slider slidable in a guideway defined by said first housing, said slider having a coil spring for contact with said abutment and compressible with respect to the slider in the fitting direction on engagement of said housings, said locking arm having a stopper or arresting member engageable with said slider in the active position to prevent relative movement of said slider in the fitting directions said stopper being disengaged in the rest position of said locking arm.

The slider provides a means of detecting half fitting of the housings, and of releasing the compression load of the coil spring when the housings are fully engaged.

Preferably the slider includes arms on either side of the locking arm, each slider arm housing a coil spring for contact with the second housing. This arrangement tends to avoid misalignment of the housings since the spring force is distributed to both sides.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
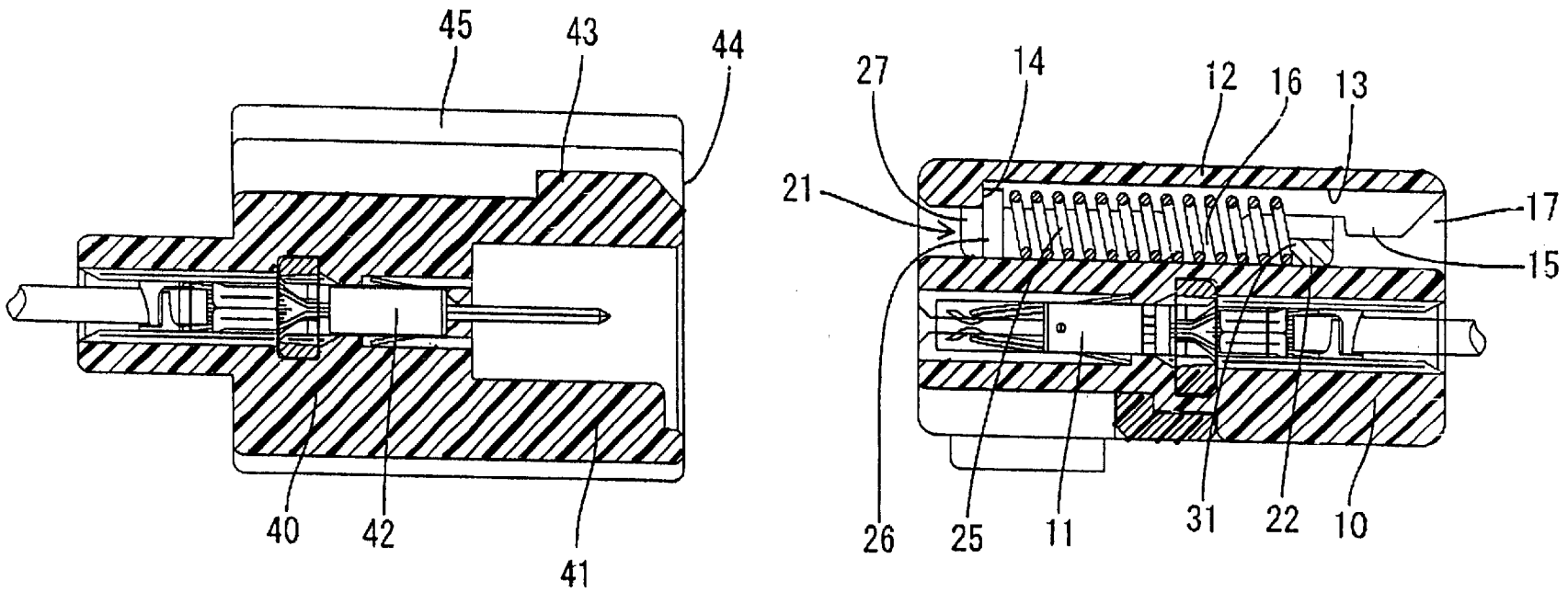
FIG. 1 is a cross-sectional view of an embodiment of the invention showing two housings in a state prior to being fitted together.
Figure 2:
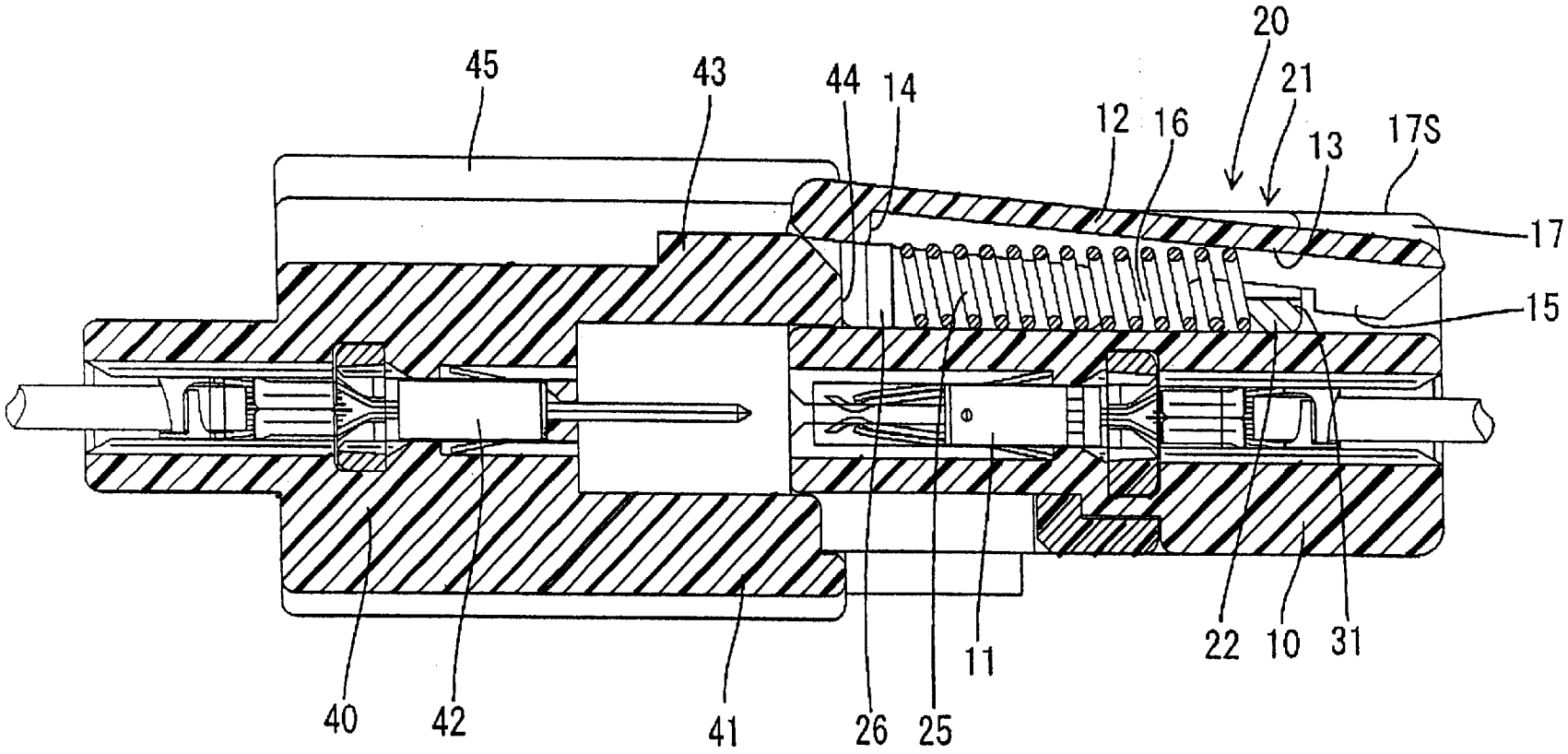
FIG. 2 is a cross-sectional view showing the two housings being fitted together.
Figure 3:
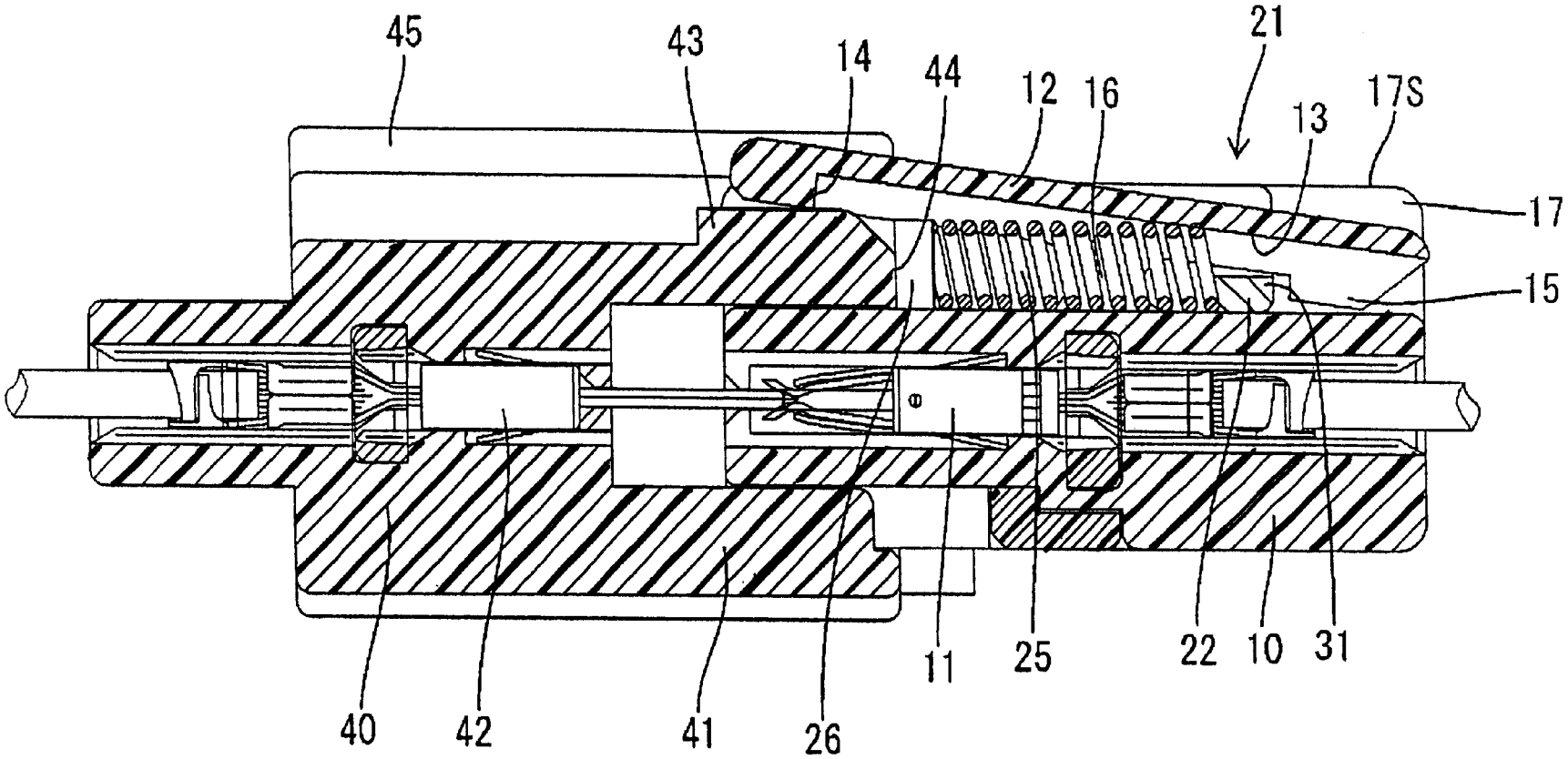
FIG. 3 is a cross-sectional view showing the two housings being fitted together.
Figure 4:
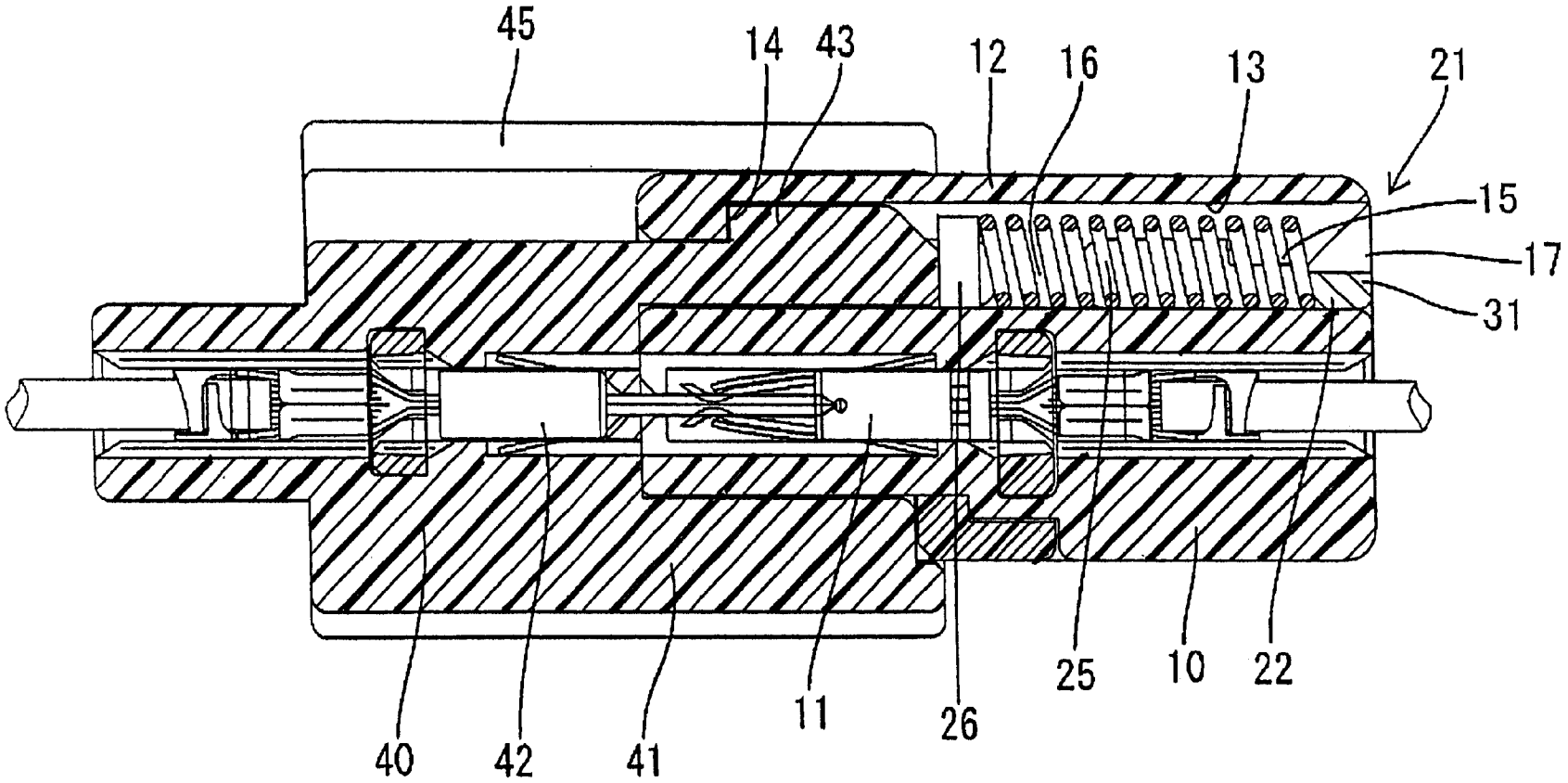
FIG. 4 is a cross-sectional view showing the two housings in a correctly fitted state.
Figure 5:
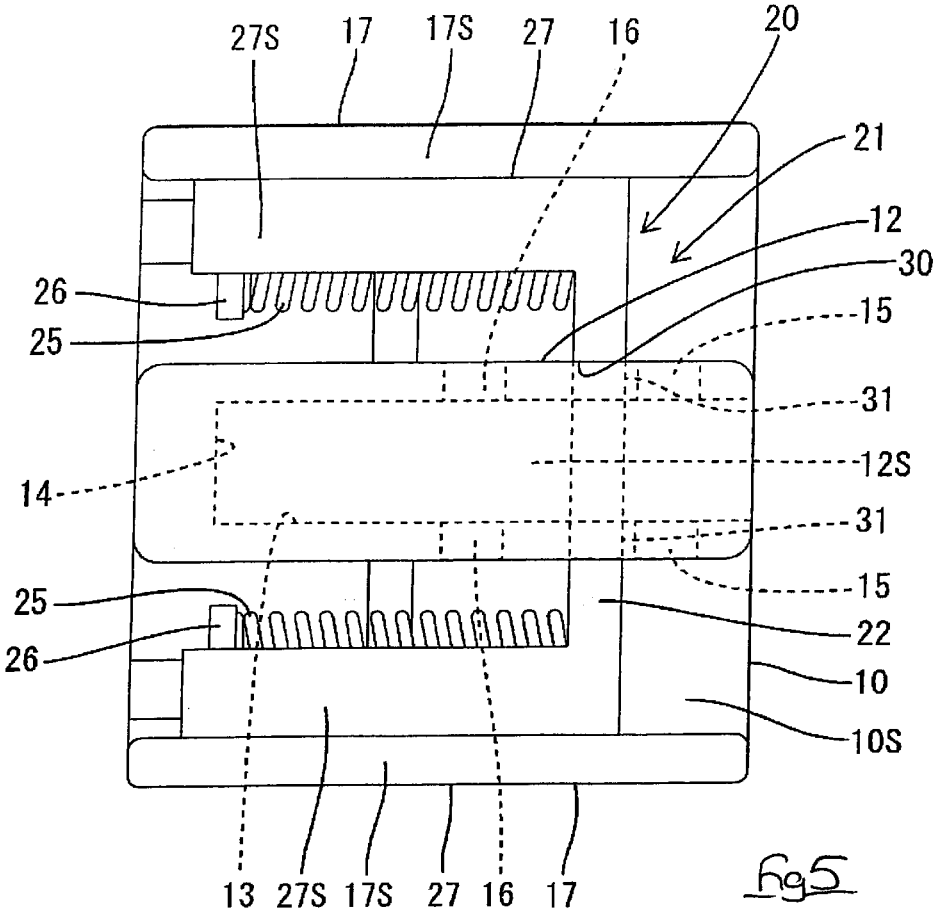
FIG. 5 is a plan view of the first housing.
Figure 6:
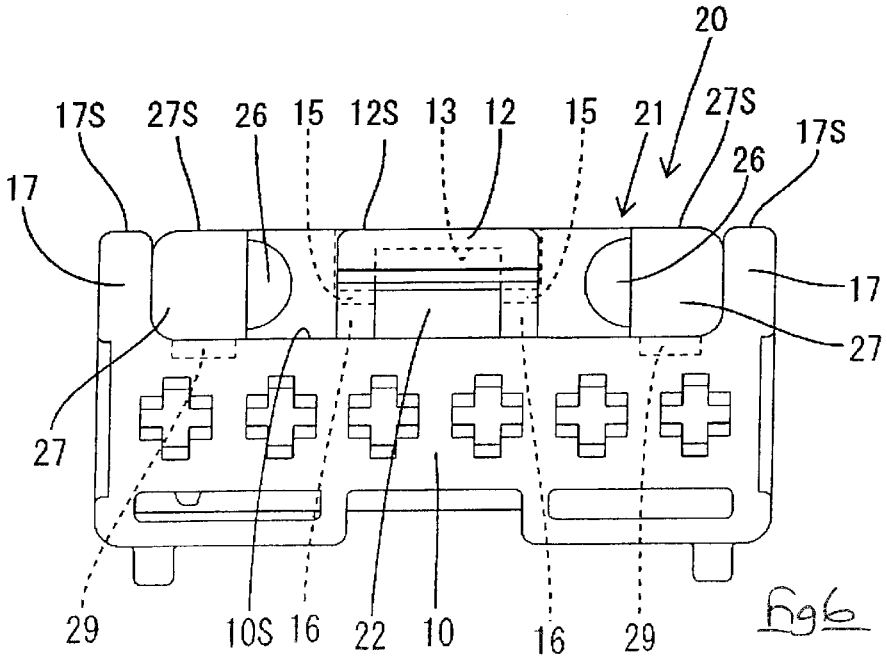
FIG. 6 is a front view of the first housing.
Figure 7:
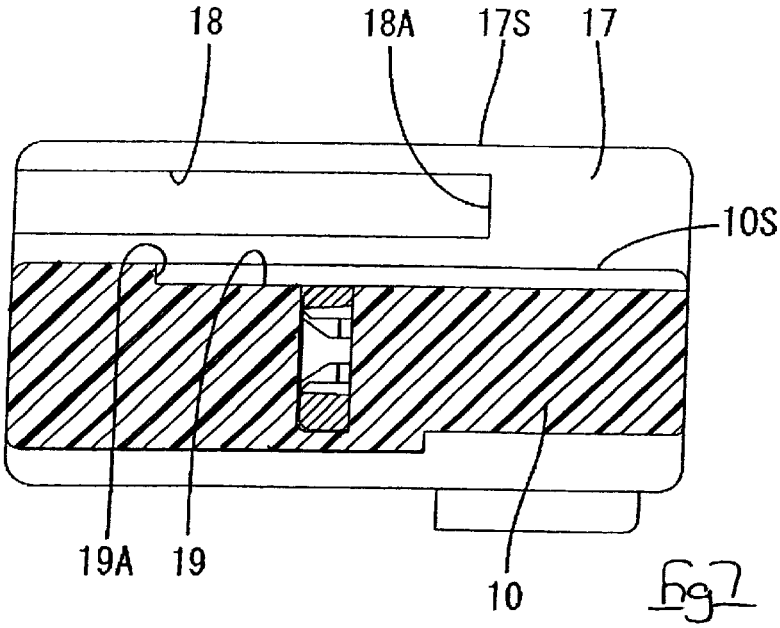
FIG. 7 is a cross-sectional view of the first housing.
Figure 8:
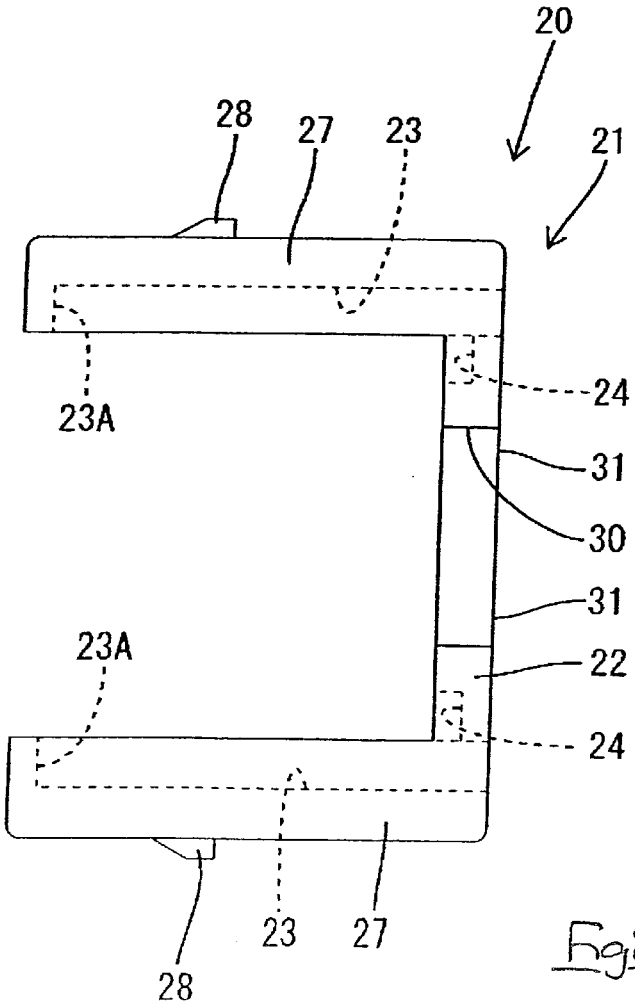
FIG. 8 is a plan view of a slider.
Figure 9:
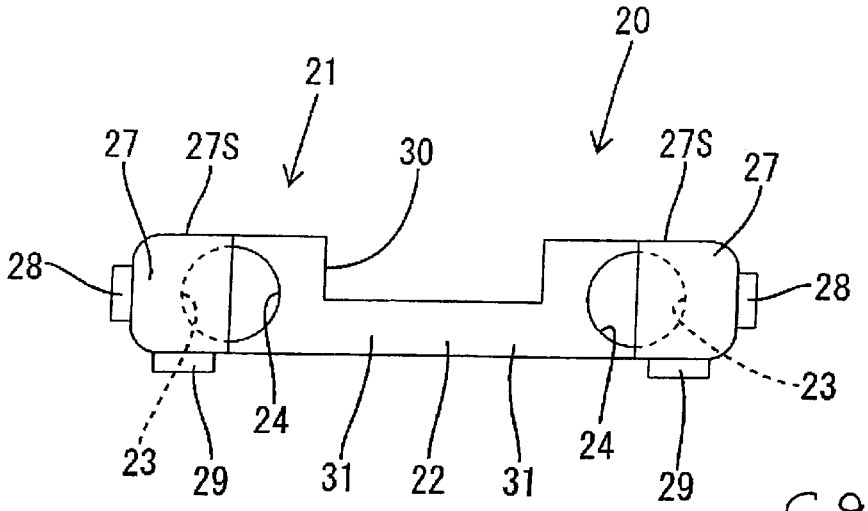
FIG. 9 is a front view of the slider.
Figure 10:
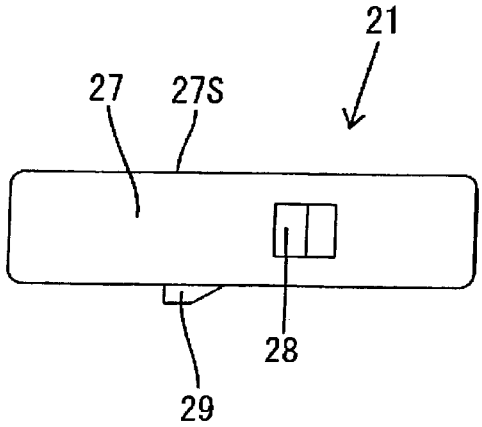
FIG. 10 is a side face view of the slider.
Figure 11:
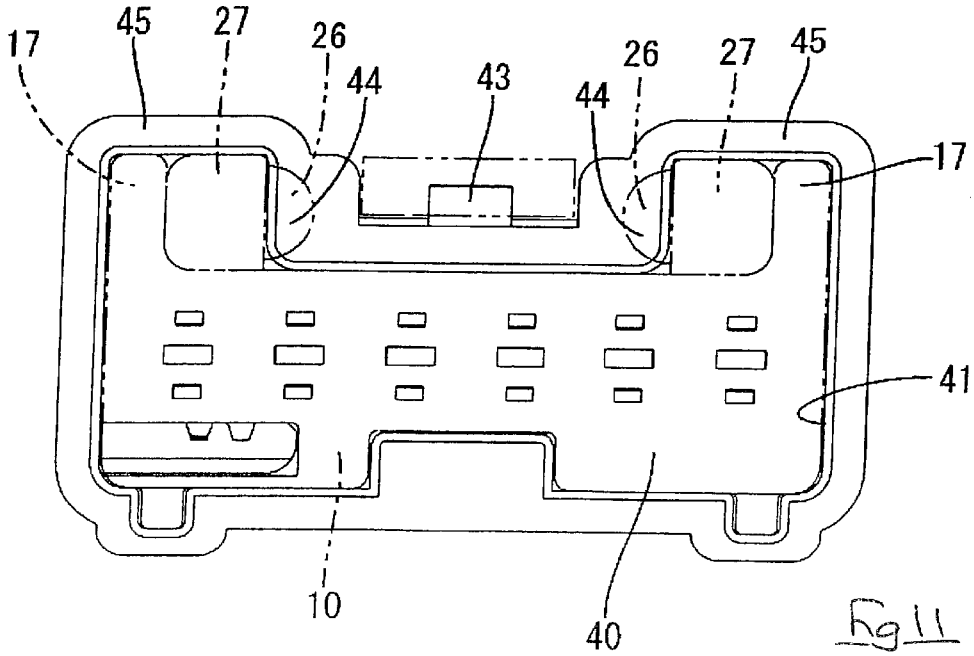
FIG. 11 is a front view of the second housing.
Figure 12:
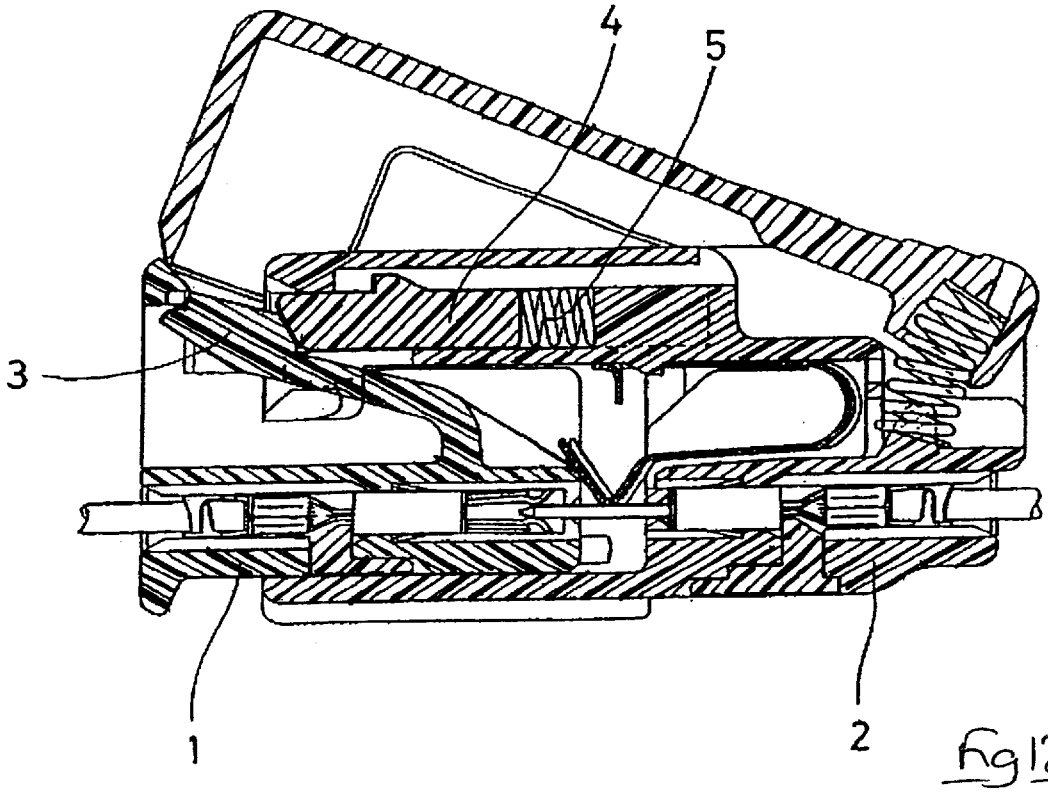
FIG. 12 is a cross-sectional view of a prior art example.

An embodiment of the present invention is described below with the aid of FIGS. 1 to 10.

A connector of the present embodiment is formed from a first housing 10 and a second housing 40 which are capable of being mutually fitted together and separated. The first housing 10 is made from plastic, and is a female housing which houses female terminal fittings 17. A locking arm 12 is formed in a unified manner on an upper face 10S of the first housing 10 at a central location relative to the left-right direction thereof (ie., the direction at a right-angle to the fitting direction of the two housings 10 and 40). The locking arm 12 has a long plate shape which extends in an anterior-posterior direction parallel to the upper face 10S of the first housing 10 A groove 13, which is cut away in a central portion (relative to the left-right direction) of a lower face of the locking arm 12, extends from a location slightly back from an anterior end thereof to a posterior end thereof A stepped member at the anterior end of the groove 13 forms a lock engaging member 14 which engages with the second housing 40 An arresting member as a pair of regulating protrusions 15 are formed at the posterior end of the locking arm 12, at left and right sides of the groove 13. The locking am 12 is joined to the upper face 10S of the first housing 10 by a pair of supports 16 which are formed on both sides of the groove 13 at a central location relative to the anterior-posterior direction of the locking arm 12. When the two housings 10 and 40 are in a separated state or in a correctly fitted state, the locking arm 12 is maintained in a locking position parallel to the upper face of the first housing 10 (see FIGS. 1, 4, and 6) While the two housing 10 and 40 are being fitted together, the locking arm 12 moves to a lock releasing position, whereby the anterior end thereof is inclined upwards and the supports 16 serve as a fulcrum (see FIGS. 2 and 3).

A pair of guiding walls 17 protrude in an anterior-posterior direction (parallel to the fitting direction of the two housings 10 and 40) along left and right side edges of the upper face 10S of the first housing 10. Upper edge faces 17S of these guiding walls 17 have approximately the same height as an upper face 12S of the locking arm 12 (when this locking arm 12 is in the locking position). Side face guiding grooves 18, which are parallel to the fitting direction of the two housings 10 and 40, are formed in inner side faces of the guiding walls 17. Posterior ends of the side face guiding grooves 18 form step-like stoppers 18A, and anterior ends thereof open onto anterior end faces of the guiding walls 17. A left and right pair of upper face guiding grooves 19, which are parallel to the fitting direction of the two housings 10 and 40, are formed in the upper face 10S of the first housing 10, at locations adjacent to the guiding walls 17. Anterior ends of the upper face guiding grooves 19 form step-like stoppers 19A, and posterior ends thereof open onto a posterior end face of the first housing 10. A position moving means 20 is provided in the space surrounded by the guiding walls 17 and the upper face 10S of the first housing 10.

The position moving means 20 consists of a slider 21 and compressible coiled springs 25. The slider 21 is made from plastic and is formed from a left and right pair of long and narrow spring housing members 27 that are parallel to the fitting direction of the two housings 10 and 40, and a joining member 22 that joins posterior end portions of the two spring housing members 27. Housing spaces 23, which cross-sectionally have a semi-circular shape, open into inner faces (i.e., mutually opposing sides) of the two spring housing members 27. Anterior ends of the housing spaces 23 form stoppers 23A which prevent the compressible coiled springs 25 from leaving the spring housing members 27 in the anterior direction. A pair of semi-circular spring receiving grooves 24 are formed in the joining member 22 at locations adjoining the housing spaces 23. Circular receiving plates 26, which are capable of moving in a unified manner in an anterior-posterior direction (the direction of fitting and separation of the two housings 10 and 40), are attached to anterior end portions (i.e., the anterior ends of the present invention) of the compressible coiled springs 25. When coil axes of the compressible coiled springs 25 are parallel to the fitting direction of the two housings 10 and 40, and these compressible coiled springs 25 are in a resiliently compressed state, they are housed within the housing spaces 23. Posterior ends of the compressible coiled springs 25 fit into the spring receiving grooves 24, and the receiving plates 26 at the anterior ends thereof make contact with the stoppers 23A. When the compressible coiled springs 25 have been housed, their inner side halves and those of the receiving plates 26 protrude inwards from the housing spaces 23. As a result, when the two housings 10 and 40 are fitted together (as described below), pushing members 44 of the second housing 40 are capable of pushing the receiving plates 26. In this state, the compressible coiled springs 25 can expand or be compressed in a direction parallel to the fitting direction of the two housings 10 and 40.

The slider 21, which has the compressible coiled springs 25 housed therein, can be moved in a direction parallel to the fitting direction of the two housings 10 and 40, outer side faces of the spring housing members 27 sliding along the inner side faces of the guiding walls 17, and lower faces of the spring housing members 27 sliding along the upper face 10S of the first housing 10. The slider 21 is capable of moving between an anterior end position, whereby protrusions 29 formed on the lower faces of the spring housing members 27 strike against the stoppers 19A at the anterior ends of the upper face guiding grooves 19, and a posterior end position, whereby protrusions 28 formed on the outer side faces of the spring housing members 27 strike against stoppers 18A at the posterior ends of the side face guiding grooves 18. Moreover, when the slider 21 is to be attached to the first housing 10, the spring housing members 27 are moved slightly inwards while they are inserted from the posterior between the two guiding walls 17, the protrusions 28 and 29 fitting with the side face guiding grooves 18 and the upper face guiding grooves 19. Further, the outer side face protrusions 28 fit with the side face guiding grooves 18, thereby preventing the slider 21 from rising above the first housing 10.

When the slider 21 has been attached to the first housing 10, upper faces 27S of the spring housing members 27 and an upper face 22S of the joining member 22 are located at the same height as the upper edge faces 17S of the guiding walls 17 and the upper face 12S of the locking arm 12 (when this locking arm 12 is in the locking position). Furthermore, the left and right pair of spring housing members 27 grip the locking arm 12, being positioned on both sides thereof, and the joining member 22 is located to the posterior of the supports 16 of the locking arm 12. That is, the position moving means 20 and the locking arm 12 are aligned in a left-right direction (in the widthwise direction) along the upper face 10S (the outer face) of the first housing 10. Moreover, the left and right pair of compressible coiled springs 25 face one another, the locking arm 12 (which is located at the centre of the first housing 10 relative to the widthwise direction thereof) being located between this left and right pair.

A groove 30 is cut away in an upper edge of the joining member 22 of the slider 21, at a central location relative to the widthwise direction thereof. This groove 30 has either the same width as the posterior end of the locking arm 12, or is slightly wider. Regulating retaining members 31 are formed in the joining member 22 at left and right edges of the area in which the groove 30 is formed. These regulating retaining members 31 extend along the left-right direction with respect to the regulating protrusions 15 located on the locking arm 12. Furthermore, when the slider 21 is in the anterior end position, the regulating retaining members 31 are located to the anterior of the regulating protrusions 15. When the locking arm 12 is in the locking position, the regulating protrusions 15 are located above the regulating retaining members 31. When the locking arm 12 is moved to the lock releasing position, the regulating protrusions 15 are located at approximately the same height as the regulating retaining members 31.

The second housing 40 is made from plastic. It has a hood 41 protruding towards the anterior, and is a male housing which houses male terminal fittings 42. Anterior ends of the male terminal fittings 42 protrude into the hood 41. A locking protrusion 43, which engages with the locking engaging member 14 of the locking arm 12, is formed on an upper face of the hood 41. A left and right pair of pushing members 44 are formed at an anterior end of the hood 41 at either side of the locking protrusion 43. These pushing members 44 are located so as to correspond, in the left-right and up-down directions, to the portions of the receiving plates 26 (at the anterior ends of the compressible coiled springs 25) that protrude inwards from the housing spaces 23. Recesses 45 are formed in the hood 41 at locations outwards relative to the left and right locations of the pushing members 44. These recesses 45 prevent the hood 41 from catching with the spring housing members 27 and the guiding walls 17.

Next, the operation of the present embodiment will be described. When the two housings 10 and 40 are to be fitted together, the slider 21 of the first housing 10 is placed in a waiting state, in the anterior end position, and the two housings 10 and 40 are brought together. As fitting begins, a lower anterior edge of the locking arm 12 strikes against the locking protrusion 43. Consequently, the locking arm 12 moves resiliently into the locking releasing position, whereby it rises over the locking protrusion 43. The regulating protrusions 15 of the locking arm 12 engage from the posterior with the regulating retaining members 31 of the slider 21 (see FIG. 2). In this engaged state, the slider 21 is prevented from moving to the posterior. At this juncture, the pushing members 44 of the second housing 40 have not yet made contact with the receiving plates 26 of the first housing 10.

As the fitting continues, the pushing members 44 make contact with the receiving plates 26, thereby pushing the receiving plates 26 towards the posterior. At this juncture, the slider 21 receives the pushing force which the receiving plates 26 and the compressible coiled springs 25 receive from the pushing members 44 at their anterior. However, due to the engagement of the regulating protrusions 15 and the regulating retaining members 31, the slider 21 is prevented from moving to the posterior. Consequently, the compressible coiled springs 25 are compressed as the receiving plates 26 are moved to the posterior, and a resilient returning force thereof is accumulated (see FIG. 3).

When the two housings 10 and 40 reach a correctly fitted state, the locking arm 12 returns resiliently to the locking position after having risen over the locking protrusion 43. The regulating protrusions 15 are now separated from the regulating retaining members 31. Consequently, the resilient returning force of the compressible coiled springs 25 moves the slider 21 to the posterior until it reaches the posterior end position, whereby the protrusions 28 strike against the stoppers 18A at the posterior ends of the side face guiding grooves 18 (see FIG. 4). The compressible coiled springs 25 have less compressed force when the two housings 10 and 40 are in the correctly fitted state than when the two housings 10 and 40 are in the half-fitted state.

Furthermore, when the fitting of the two housings 10 and 40 is halted while these two housings 10 and 40 are in the half-fitted state (the state shown in FIG. 3), the resilient returning force of the compressible coiled springs 25 pushes the second housing 40 back, this allowing the half-fitted state of the two housings 10 and 40 to be detected.

In the present embodiment, the position moving means 20 and the locking arm 12 are aligned along the outer face (the upper face) of the first housing 10. Consequently, the height of the first housing 10 is reduced, and as a result the height of the connector overall can be reduced.

Furthermore, the moving force of the pair of compressible coiled springs 25 is distributed equally at the left and right sides. Consequently, when the second housing 40 is pushed back when the two housings 10 and 40 are in the half-fitted state, the two housings 10 and 40 do not become misaligned and catch against one another, nor does the slider 21 become misaligned and catch.

The present invention is not limited to the embodiments described above with the aid of figures. For example, the possibilities described below also lie within the technical range of the present invention. In addition, the present invention may be embodied in various other ways without deviating from the scope thereof.

(1) In the present embodiment, the first housing, which is provided with the position moving means and the locking arm, is a female housing, and the second housing is a male housing. However, according to the present invention, it is equally possible to have the first housing as a male housing, and the second housing as a female housing.

(2) In the present embodiment, the compressible coiled springs are provided as a left nd right pair. However, according to the present invention, a single compressible oiled spring may equally well be provided.

What is claimed is:

1. An electrical connector comprising first and second housings engageable on a fitting axis, said housing having an external profile defined by exterior surfaces and including a body, a locking arm pivotally attached to the body, and a biasing member movably disposed on the body, the locking arm being generally parallel with said fitting axis and engaging a locking tooth of said second housing upon partial engagement of the housings such that the locking arm is resiliently pivoted from a rest position to an active bent position until the housings are fully engaged at which point the locking arm returns to the rest position in locked engagement with the locking tooth, the biasing member being positioned laterally of the locking arm and movable in directions parallel to the fitting axis, the locking arm and the biasing member having outermost surfaces that are uncovered along their entire lengths and which define the exterior surfaces of the first housing along one side thereof, and an abuttment disposed on the second housing to push the biasing member in one of the parallel directions as said first and second housings are engaged.

2. A connector according to claim 1 wherein the outermost surfaces of said biasing member and said locking arm are flush with each other.

3. A connector according to claim 2 wherein said outermost surfaces of the locking arm and the biasing member are flush with outer spices of said body along said one side of the first housing.

4. A connector according to claim 1 wherein said biasing member is a slider slidable in a guideway defined by said body, said slider having at least one coil spring for pressing against said abutment and compressible with respect to the slider along a direction parallel to said fitting axis during engagement of said housings, said locking arm having an arresting member engageable with said slider when the locking arm is in the active bent position to prevent movement of said slider relative to the locking arm, said arresting member being disengaged when the locking arm is in the rest position.

5. A connector according to claim 4 wherein said locking arm comprises a beam having a resilient foot between the ends thereof, said beam having a latching member at one end for engagement with said locking tooth and said arresting member at the other end thereof and said slider comprises a frame having a base extending generally orthogonally to said fitting axis and two legs extending parallel to the fitting axis, with one leg on either side of said locking arm.

6. A connector according to claim 5 wherein said base passes under said locking arm at a posterior side of said foot to thereby limit movement of said locking arm by abutment therewith.

7. A connector according to claim 6 wherein said arresting member comprises a projection of said locking arm that is engageable with a posterior side of said base.

8. A connector according to claim 7 wherein said arresting member is engageable with said first housing so as to limit pivoting movement of said locking arm from the rest position.

9. A connector according to claim 5 wherein said at least one coil spring is contained in one of the slider legs and another coil spring is contained in the other of the slider legs, the compression axes of said springs being parallel to the fitting axis, one respective end of each spring abutting said base, and the other respective end of each spring being positioned for pressing against a respective abutment of said second housing.

10. A connector according to claim 9 wherein a receiving plate is provided at the other respective ends of said springs for direct contact with a respective abutment.

11. A connector according to claim 5 wherein said first housing includes opposite upstanding side walls extending parallel to said fitting axis, said slider and locking arm being disposed between said side walls, and the tops of said side walls being flush with said outermost surfaces of the slider and locking arm flush outer surfaces when the locking arm is in the rest position.

12. A connector according to claim 11 wherein said side walls define facing guide channels to locate said slider for movement in the fitting direction.

13. A connector according to claim 12 wherein said guide channels are blind, the ends thereof stopping movement of said slider to the posterior.

14. A connector according to claim 8 wherein said at least one coil spring is contained in one of the slider legs and another coil spring is contained in the other of the slider legs, the compression axes of said springs being parallel to the fitting axis, one respective end of each spring abutting said base, and the other respective end of each spring being positioned for pressing against a respective abutment of said second housing.

15. A connector according to claim 14 wherein a receiving plate is provided at the other respective ends of said springs for direct contact with a respective abutment.

16. A connector according to claim 15 wherein said first housing includes opposite upstanding side walls extending along said fitting axis, said slider and locking arm being disposed between said side walls, and the tops of said side walls being flush with said slider and locking arm flush outer surfaces when the locking arm is in the rest position

17. A connector according to claim 16 wherein said side walls define facing guide channels to locate said slider for movement in the fitting direction.

18. A connector according to claim 17 wherein said guide channels are blind, the ends thereof stopping movement of said slider to the posterior.

* * * * *